United States Patent [19]

Hamel

[11] Patent Number: 4,788,924

[45] Date of Patent: Dec. 6, 1988

[54] SAILING SYSTEM

[76] Inventor: Renald Hamel, 3320 Lacoste, Quebec, Canada, G2E 4P8

[21] Appl. No.: 105,616

[22] Filed: Oct. 8, 1987

[30] Foreign Application Priority Data

Oct. 13, 1986 [GB] United Kingdom ..... 8624460

[51] Int. Cl.[4] ..... B63H 9/04

[52] U.S. Cl. ..... 114/39.1; 114/90; 114/102

[58] Field of Search ..... 114/102, 103, 39.1, 114/39.2, 89, 90, 91

[56] References Cited

U.S. PATENT DOCUMENTS

| | | | |
|---|---|---|---|
| 606,104 | 6/1898 | Twining | 114/103 |
| 2,126,665 | 8/1938 | Rowland | 114/103 |
| 3,858,542 | 1/1975 | Lenoble | 114/102 |
| 3,981,258 | 9/1976 | Smith | 114/39 |
| 4,068,607 | 1/1978 | Harmon | 114/39 |
| 4,228,750 | 10/1980 | Smith et al. | 114/39.1 |
| 4,276,033 | 6/1981 | Krovina | 114/39 |
| 4,280,428 | 7/1981 | Werner, Jr. | 114/39 |
| 4,382,417 | 5/1983 | Talve | 114/102 |
| 4,382,418 | 5/1983 | Talve | 114/39 |
| 4,497,272 | 2/1985 | Veazey | 114/103 |
| 4,501,216 | 2/1985 | Voslamber | 114/39 |
| 4,610,212 | 9/1986 | Petrovich | 114/39.1 |

FOREIGN PATENT DOCUMENTS

| | | | |
|---|---|---|---|
| 912921 | 10/1972 | Canada . | |
| 963736 | 3/1975 | Canada . | |
| 1002393 | 12/1976 | Canada . | |
| 1011178 | 5/1977 | Canada . | |
| 1125105 | 6/1982 | Canada . | |
| 1127911 | 7/1982 | Canada . | |
| 1173302 | 8/1984 | Canada . | |
| 1186956 | 5/1985 | Canada . | |
| 0083806 | 7/1983 | European Pat. Off. . | |
| 2938877 | 4/1981 | Fed. Rep. of Germany . | |
| 1156952 | 3/1958 | France . | |
| 2532614 | 3/1984 | France . | |
| 2538775 | 7/1984 | France . | |
| 1020310 | 5/1983 | U.S.S.R. | 114/39.1 |

OTHER PUBLICATIONS

European Patent Application 1/87, Felisati.

*Primary Examiner*—Joseph F. Peters, Jr.
*Assistant Examiner*—Edwin L. Swinehart
*Attorney, Agent, or Firm*—Foley & Lardner, Schwartz, Jeffery, Schwaab, Mack, Blumenthal & Evans

[57] ABSTRACT

A sail assembly for use with a hull, comprising a base and a mast mounted on the base for rotation about a vertical axis, the mast also extending at a mast tilt angle with respect to the vertical. A sail structure, which includes a sail frame and a sail fixed to the frame at predetermined points of attachment, has its frame mounted on the tip of the mast by a universal joint and so that the tip of the mast is at, or close to, the center of gravity of the sail. A manually operable steering mechanism is provided on the mast, adjacent to the base, and a rigging, including steering ropes, operatively joins the steering mechanism and the sail frame at points of connection adjacent the aforesaid points of attachment for moving the frame and sail in unison about the universal joint when the steering mechanism is operated.

15 Claims, 11 Drawing Sheets

SAILING SYSTEM

BACKGROUND OF THE INVENTION

1. Field of the Invention

The present invention relates to an improved sailing system for light or heavy boats, canoes, surboards or the like, hereinafter generically referred to as hulls, with respect to the invention.

2. Background of the Invention

Some conventional sail boats have one or more sails hanging from vertical masts so that the resultant of the wind forces is applied high above the resultant of the countering horizontal hull resistance. Such in a known sail system thus gives rise to large heeling and diving motions which alter the boat performance and stability. It also generates lateral torques which must be compensated by using a rudder which adds further to the water resistance.

On other sail boats, the sails hang from the tip of the masts and require a complicated rigging so that the sail management requires much expertise. Examples of these sail boats have been found during a search of the prior art which revealed the following documents:

| Canadian Patents | |
|---|---|
| 912,921 (1972) | 963,736 (1975) |
| 1,002,393 (1976) | 1,011,178 (1977) |
| 1,125,105 (1982) | 1,127,911 (1982) |
| 1,173,302 (1984) | 1,186,956 (1985) |
| U.S. Pat. No. | |
| 2,126,665 (1938) | 3,858,542 (1975) |
| 3,981,258 (1976) | 4,068,607 (1978) |
| 4,228,750 (1980) | 4,280,428 (1981) |
| 4,382,417 (1983) | 4,497,272 (1985) |
| 4,501,216 (1985) | |

A study of these references shows that the sail systems disclosed are not capable of avoiding the above drawbacks.

SUMMARY OF THE INVENTION

The object of the present invention is to provide a sail system which avoids the above mentioned difficulties.

The sail system according to the invention comprises a sail structure as such, including a sail and a sail frame hanging at the tip of a tilted mast. The sail system according to the invention also comprises a steering mechanism that is close to the hull so as to be of easy reach to the hull master. More important so, the sail system according to the invention further comprises a rigging of extreme simplicity entirely controllable with the steering mechanism.

More specifically, the sail system of the invention comprises a sail assembly for use with a hull, the assembly comprising: a mast base; a mast; means for mounting the mast on the base for rotation of the mast about a vertical axis, the mast being so mounted as to extend at a mast tilt angle with respect to the vertical axis and having a tip at the end thereof away from the base; a sail structure including a sail frame and a sail fixed to the frame at predetermined points of attachment thereon; a universal joint mounting the sail frame on the mast tip for the mast tip to be at, or close to, the center of gravity of the sail; manually operable steering means on the mast, adjacent the base; and rope means including ropes operatively joining the steering means and the sail frame at points of connection on the sail frame adjacent the points of attachment for moving the frame and sail in unison about the universal joint when the steering means are operated.

According to a preferred embodiment of the invention, the points of connection of the ropes on the sail frame are at corners of a geometrical figure and the steering means comprise a manually operable, closed steering frame geometrically similar to the geometrical figure, said steering frame having junction points located similarly to the location of the points of connection. A first sleeve is mounted on the mast for free rotation only about the mast axis, and located in the plane of the steering frame when the steering frame is at rest. Flexible means are used to join the first sleeve and the steering frame at said junction points. In this preferred embodiment, the rope means also comprise a pulley on the steering frame at each of the junction points. A second sleeve is mounted on the mast for free rotation only, about the mast axis, and located intermediate the first sleeve and the universal joint. Rope lengths are also provided, each joining one of the points of connection and the second sleeve after winding around one of the steering frame pulleys.

According to another preferred embodiment, the points of connection of the ropes on the sail frame are at corners of a first geometrical figures and the steering means comprise a mast plate and means solidly mounting the end of the mast, away from the frame universal joint, on one face of the mast plate for the mast to extend perpendicularly therefrom. The mast plate has rope guiding holes therethrough disposed at corners of a second geometrical figure similar to the first geometrical figure. The mast has an axial extension projecting from the other face of the mast plate. An elongated steering handle is interconnected at one end by a further universal joint to the mast axial extension. In this embodiment, the rope means also comprise a sleeve mounted on the handle at a predetermined distance from the further universal joint, the sleeve having rope guiding elements therearound. Rope length compensating means are provided including discs between the sleeve and mast plate and cords fixed at one end to the discs and fixed at the other end to the mast plate, adjacent the universal joint. Rope lengths are also provided for joining one of the points of connection of the sail frame and one of the discs after having passed through one of the rope guiding holes of the mast plate and having wound around one of the rope guiding elements of the sleeve.

BRIEF DESCRIPTION OF THE DRAWINGS

A non restrictive description of preferred embodiments of the invention will now be given with reference to the appended drawings, wherein.

DESCRIPTION OF PREFERRED EMBODIMENTS

Figure 1:
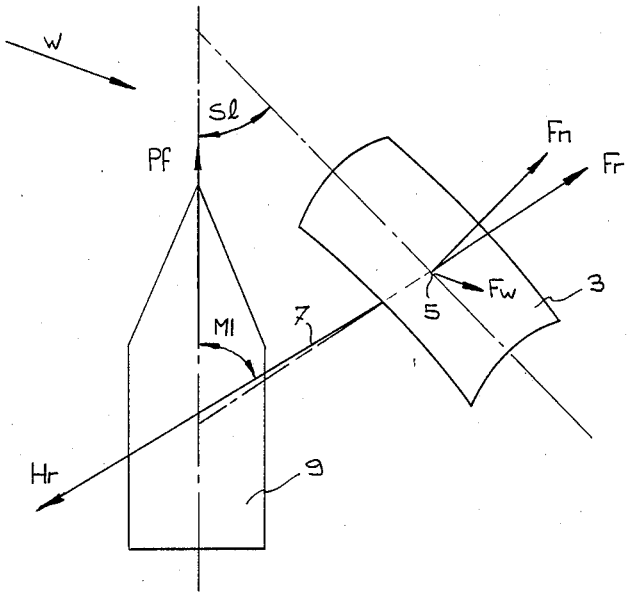
FIG. 1 is a diagrammatic top plan view of a hull provided with a sail assembly according to the invention and using a rectangular sail.
Figure 2:
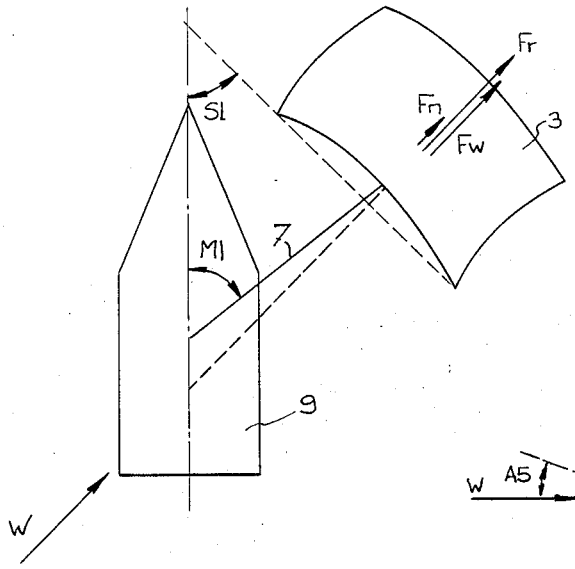
FIGS. 2, 2*a*, 2*b* and 2*c* are views similar to FIGS. 1, 1*a* and 1*b* intended to illustrate the action of various wind forces on the sail and how the sail system according to the invention can act as a powerful hull heeling stabiliser when the sail is positioned down wind.

Referring to FIGS. 1 and 2, particularly, the wind forces acting on the sail are broken up into two components: one component Fn normal to the sail frame 1 and another Fw parallel to the wind direction W. Their resultant is represented by Fr. The resultant of the horizontal hull resistance is shown by Hr. Propulsive force is represented by Pf.

The sail system according to the invention basically comprises a sail 3 hung to a frame 1 to form a sail structure that hinges laterally and transversaly at the tip 5 of a mast 7 extending substantially beyond the side of a hull 9 which may be that of any floating vessel or a vessel mounted on skis for riding on ice and on wheels for riding on ground, as aforesaid. The mast lateral angle M1 is unlimited; the mast 7 can swing port or starboard, towards the bow or the stern of the boat. Also, the mast tilt A3 is adjustable. The sail 3 must be kept on the leeward side of the hull 9. The sail 3, its frame 1, attachments and controls are primarily designed to operate with the inner side of the sail 3 exposed to windward but damages are avoided if the outer side is exposed to windward.

The tip 5 of the mast 7 determines the location of the center of gravity of the sail 3. A sail steering mechanism (31, FIG. 6) provides quick and handy control of the sail tilt St and of the sail lateral angle S1. The sail steering mechanism also provides corresponding rotation of the sail 3 around the mast axis.

Figure 5:
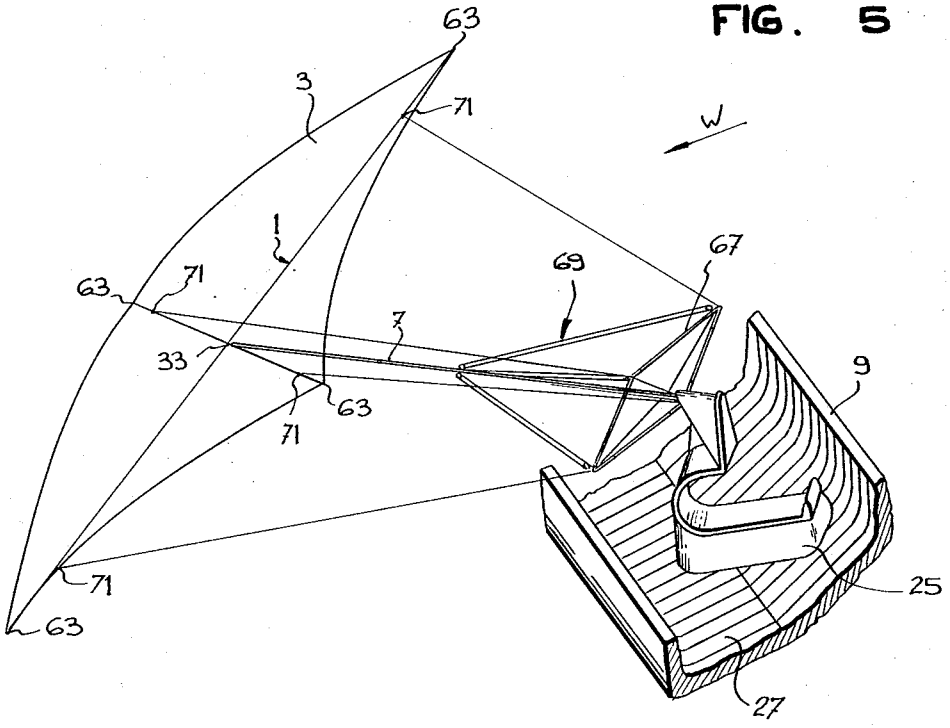
FIG. 5 is a perspective view of a sailing assembly mounted on a partially illustrated hull and requiring no attachment to the hull.
Figure 16:
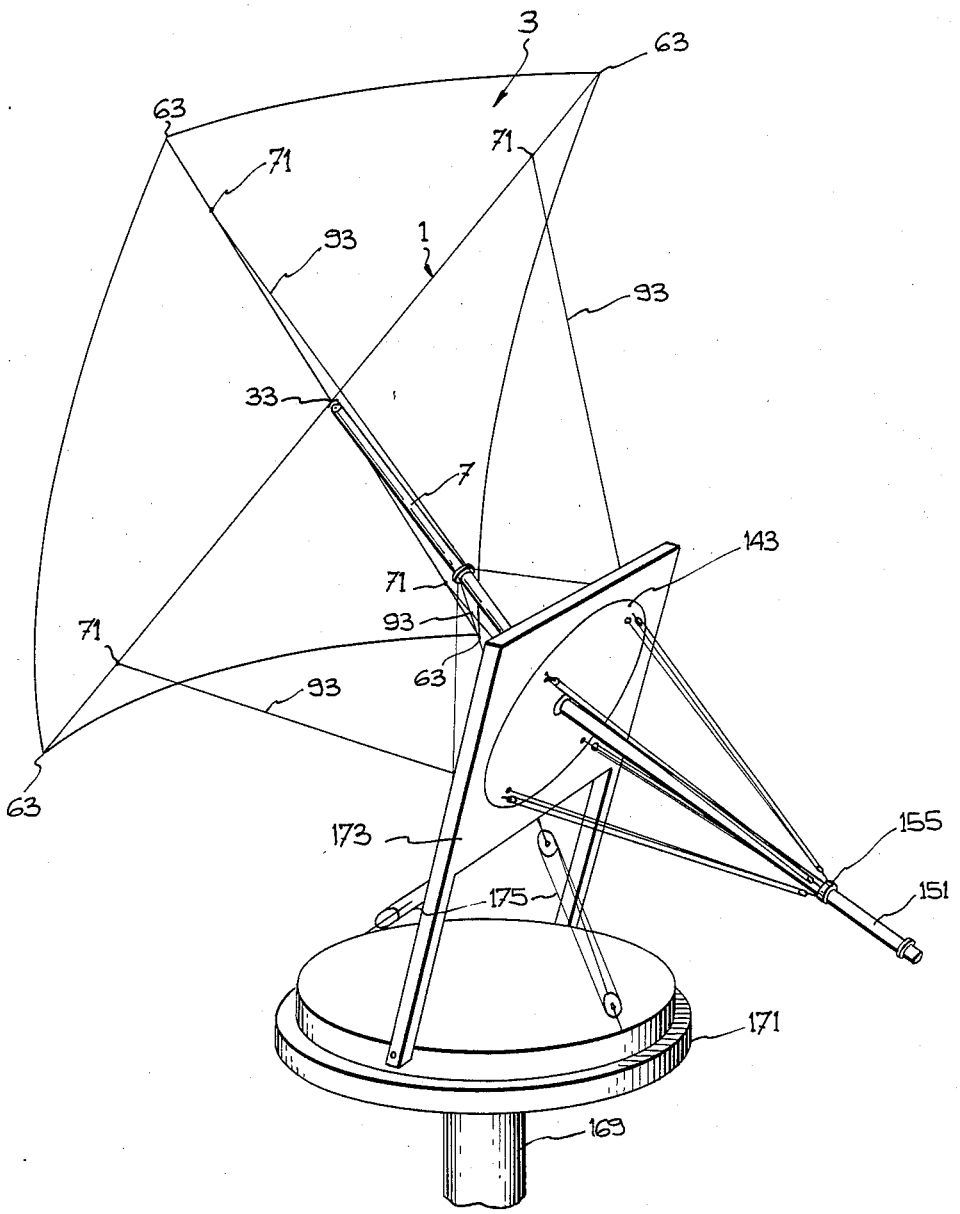
FIG. 16 is a perspective view of a sailing assembly according to another embodiment and for heavier boats.

The sail 3 is tied to its frame 1 which in turn is attached to steered sets of ropes. The sail steering mechanism releases or pulls these ropes in such a way that the sail frame 1 remains undistorted under wide sweepage of the sail angle with the mast 7. The sail steering mechanism is totally supported by and mounted on the mast 7 and on a rotatable mast base (FIGS. 5 and 16). In other words, the mast lateral angle M1 does not interfere with the sail steering mechanism nor with the sail trim.

With control of the sail tilts St, a sailor controls the location of the resultant of the sail force along the hull vertical axis. Increasing the sail tilt lowers the location while decreasing it moves it up. As this location gets closer to the level of horizontal hull resistance Hr, the sail heeling torque is reduced. If this location gets below the level of hull lateral resistance, then a heeling torque is generated in the opposite direction and this characteristic is of particular interest under adverse wave conditions. However, increasing the sail tilt also reduces the propulsive force Pf. For example, the typical forces shown in FIG. 1*b* imply a heeling torque that can be eliminated by a larger sail tilt St accompanied with a reduction of the propulsive force Pf. However, it can possibly be counteracted by transfer of crew weight, without reduction of the propulsive force.

For windward sailing, mast length requirement varies with hull stability and weight transfer associated with change of tacking course. An unstable hull requires a longer mast than a stable hull of same capacity because gap between level of resultant sail force Fr and level of hull lateral resistance Hr is more critical with an unstable hull.

On unstable boats such as sailboards, rowboats and canoes, gravitation and wind forces on sail and rigs extending beyond the hull side make them even more unstable under improper use of the sail assembly of the invention. Addition of side floaters to the hull may be desirable or required and if added, they may also be designed to improve the hull lateral resistance to water. However, the skilled sailer can handle the resultant of the heeling and diving forces through proper management of the sail tilt and weight transfer. On more stable boats, proper management of the sail tilt provides the sailor with means of minimizing hull resistance to water through effective control of heeling and diving forces. It also adds to security under adverse wave conditions.

Figure 2A:
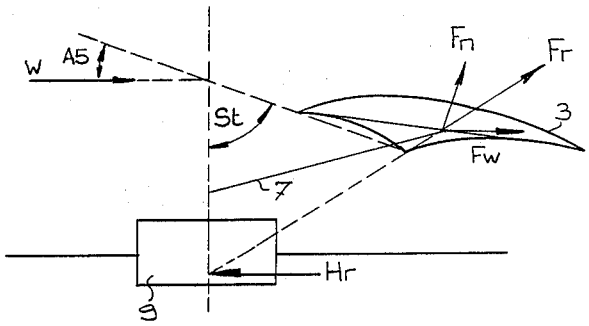
Figure 2B:
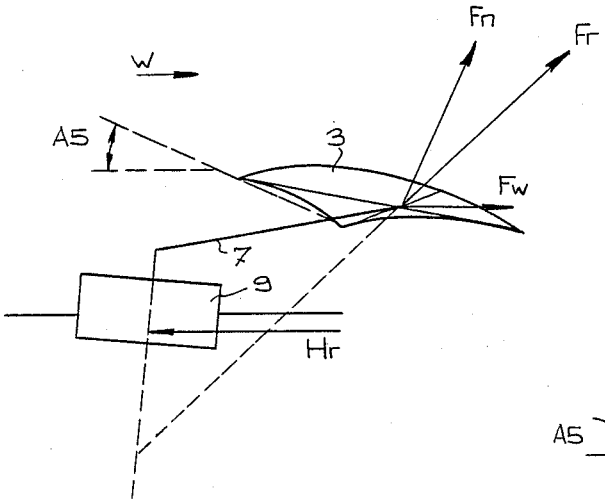
Figure 2C:
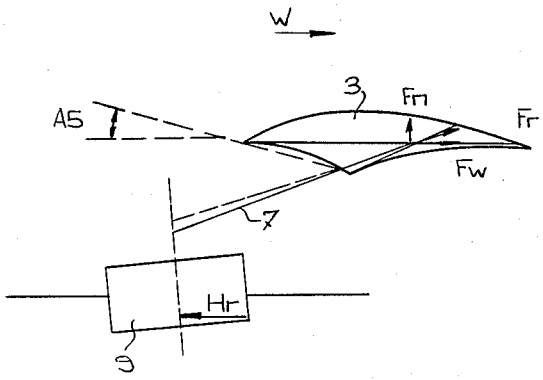
Figure 4:
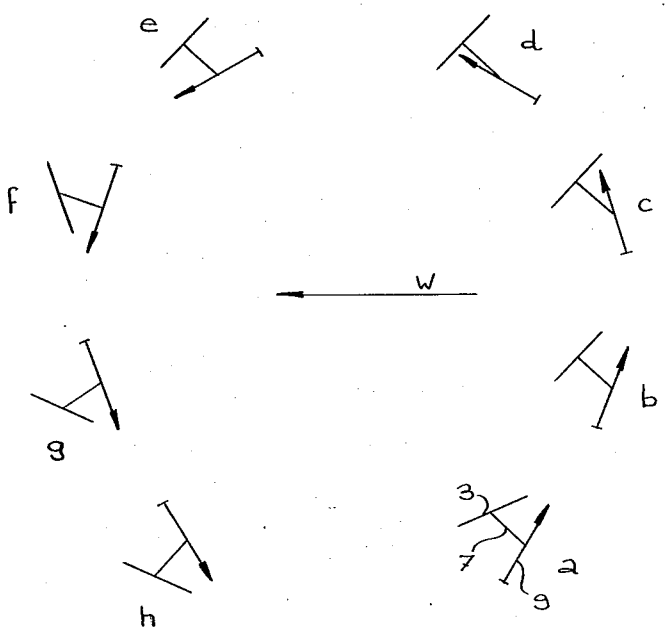
FIGS. 4*a* to *h* are diagrammatic views showing an outward change of course.
Figure 3:
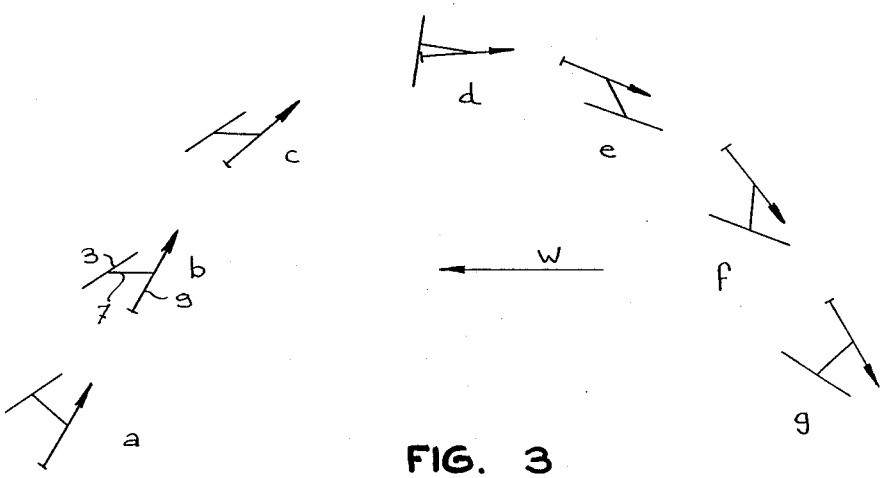
FIGS. 3*a* to *g* are diagrammatic views illustrating a typical tacking course in association with the sail system of the invention.

As shown in FIGS. 2*a*, 2*b* and 2*c*, the sail assembly of the invention becomes a powerful stabilizer against heeling when the sail is positioned downwind and sideway with a high sail tilt St. The sailor has the option of managing sail tilt, sail lateral angle and mast lateral angle or locking them. Once mast tilt A3 and sail tilt St are locked, the sailing system keeps providing forces towards equilibrium (FIG. 2*a*). The sail angle A5 with the horizontal wind direction W is slightly larger than the critical angle wherein the lifting force becomes nil. At such low angles, angular variations produce changes on the sail lift force several times larger than those on drag force. Under downwind heeling (FIG. 2*b*), the resultant sail force Fr focusses below the level of the resultant horizontal hull rèsistance, thus generating a torque towards equilibrium (FIG. 2*a*). Under upwind heeling (FIG. 2*c*) the resultant of the sail force Fr focusses above the level of the resultant of the horizontal hull resistance thus generating a torque towards equilibrium (FIG. 2*a*). This facility is also of particular interest when boarding surfboats.

Figure 1A:
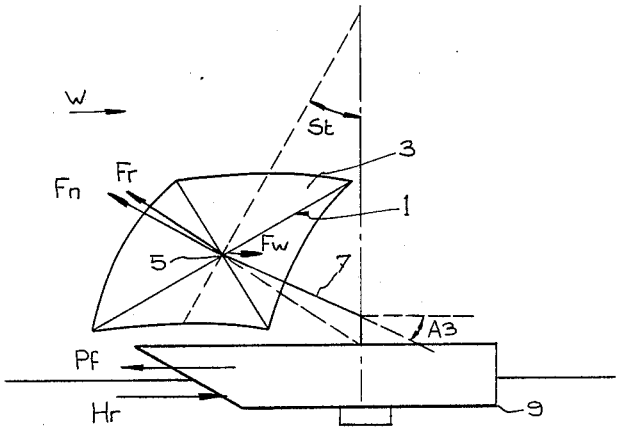
FIGS. 1*a* and 1*b* being a side view and a rear view, respectively.
Figure 1B:
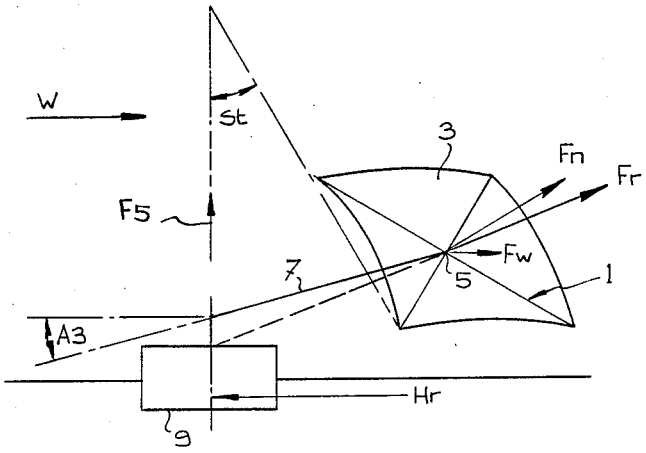

Variable mast tilt A3 is a characteristic specially attractive for hydrofoils and acrobatic sailing. As shown in FIGS. 1, 1*a* and 1*b*, the propulsive force Pf is maximized with the sail nearly vertical and close to water level; conversely the lifting force F5 is optimized as the sail tilt St and mast tilt A3 are large. Variation of the mast tilt A3 is often accompanied with a change of sail tilt St in order to keep the resultant of the sail force Fr focussing close to level of the resultant of the hull resistance Hr. FIGS. 2*a*, 2*b* and 2*c* also show reduction of the resultant of the sail force Fr as the sail tilt St is increased; this allows the sailor to limit stresses on the equipment in case of excessive winds.

Through govern of the sail lateral angle S1 and mast lateral angle M1, the sailor controls the boat direction. The resulting sail force Fr combined with the resulting horizontal hull resistance Hr generates a boat steering torque. Typical forces on FIG. 1 result in torque steering port. In order to keep actual direction, the location of the resulting sail force on the boat axis must coincide with location of the lateral hull resistance. So, in this example, the sailor could achieve this by a slight decrease of the sail lateral angle S1.

FIGS. 3*a* to 3*g* show a typical tacking course with the proposed sailing assembly. The mast is gradually rotated and it crosses the stern between (d) and (e). FIGS. 4*a* to 4*h* show an outward change of course. Again a gradual mast rotation is noted but this time, the mast 7 crosses the bow between (c) and (d).

Location of the mast base along the boat longitudinal axis has an impact on the mast strenght and mast steering torque requirements. These requirements are minimized if the mast base coincides with location of the resultant of the lateral hull resistance. Then the lateral torque to the mast is applied only to change the boat direction since the mast lateral angle sets naturally so that the resultant of the sail force focusses at the mast base. If the mast base is too far away from the location of the resultant lateral hull resistance, then the mast strength and mast steering requirements become unpractical or the mast will bend widely thus requiring the use of a rudder to control the boat direction. Adjustment of the location of the mast base or of the heel location along the boat longitudinal axis is sometime a must for manoeuvrability under wide boat load conditions. On multimast arrangements of the proposed sailing system, rudder use may be avoided by proper selection of sail size and mast base locations.

The level of the mast base also has an impact on the mast strength requirements. FIGS. 1*a*, 1*b*, 2*a*, 2*b* and 2*c* show the resultant of the sail force not focussing at the mast base level; then vertical bending moments are applied against the mast.

Although the drawings show rectangular sails, the sailing system herein described and claimed can be adapted to other sail shapes. The capability to rotate the sail around the mast axis with corresponding rotation of the sail steering mechanism allows major change to sail concavity without addition of stress to the sail; this capability is also a major step towards substitution of the sail by other types of foils not designed for forward-backward symmetry of use.

Figure 6:
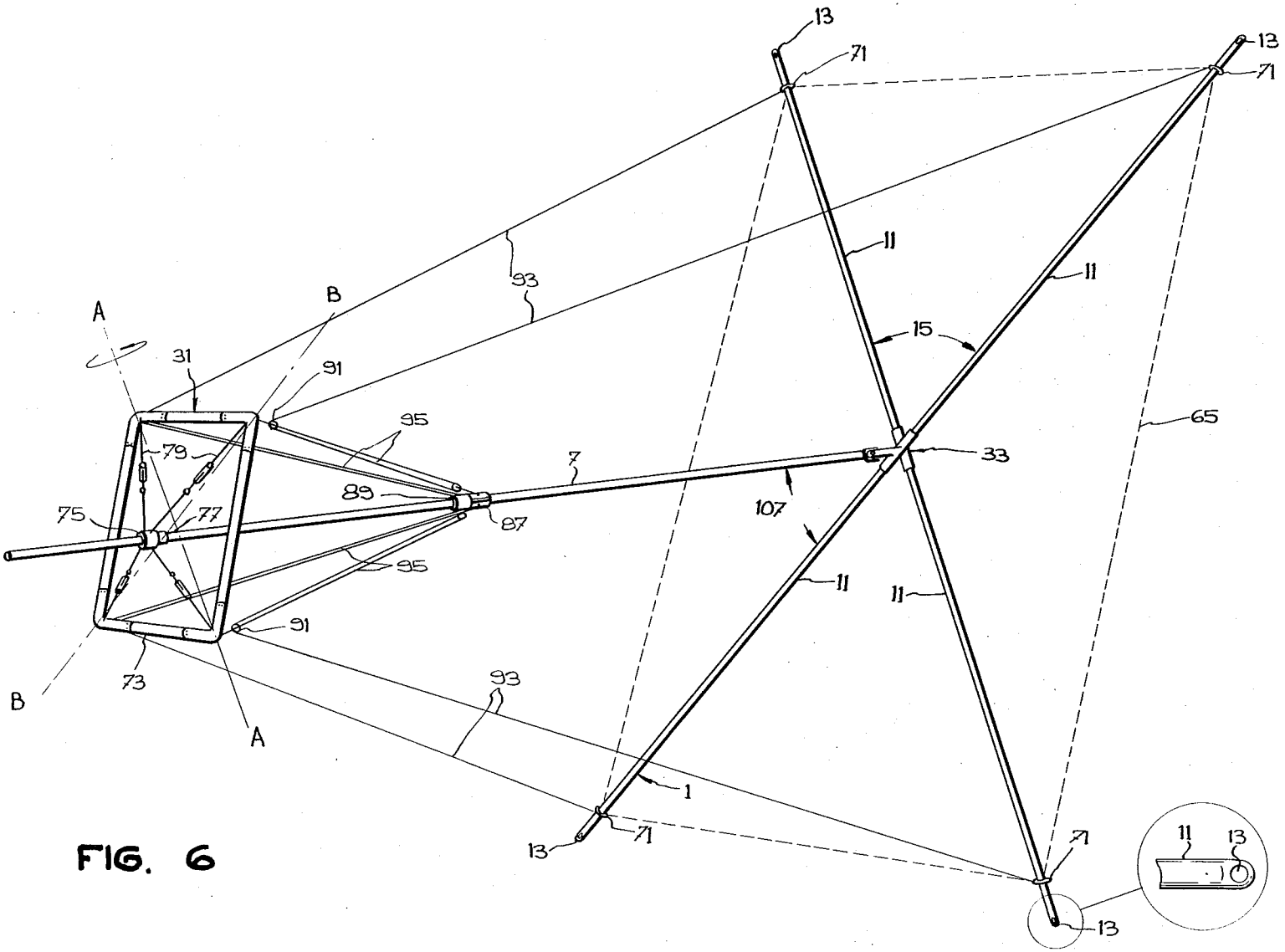
FIG. 6 is a perspective view of a sail frame and sail steering mechanism used in the sailing assembly of FIG. 5.
Figure 14:
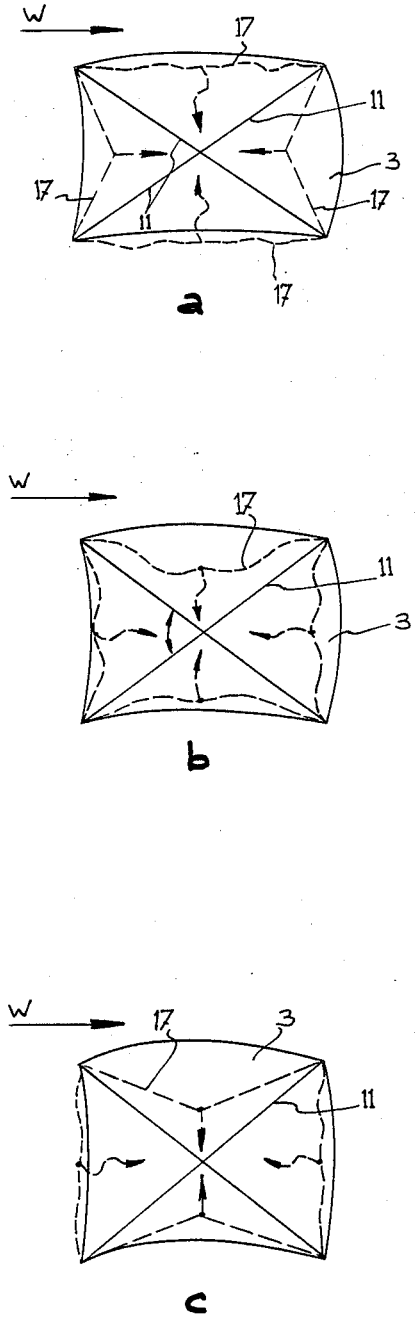
FIGS. 14*a*, 14*b* and 14*c* are diagrammatic plan views of a sail structure having a rectangular sail with perimeter ropes on the sail frame.
Figure 15:
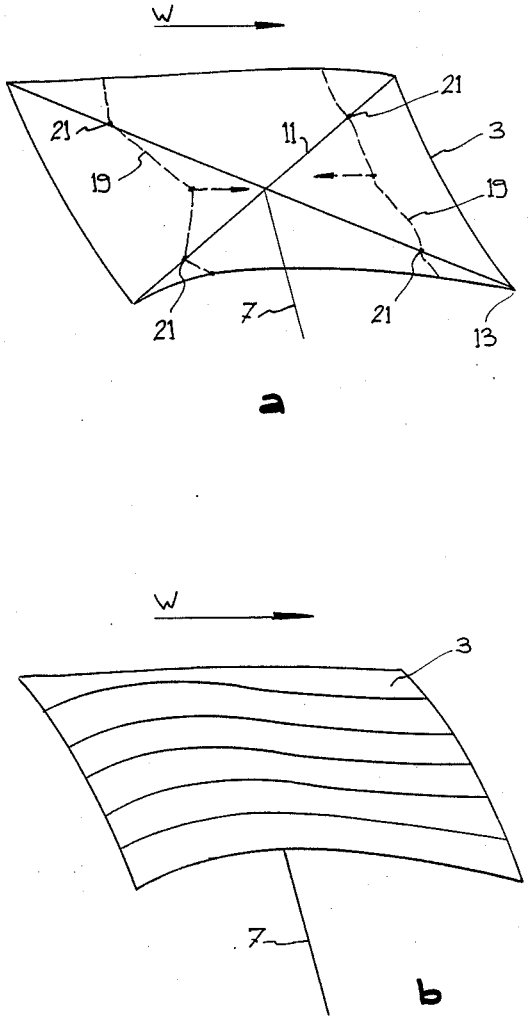
FIGS. 15*a* and 15*b* are diagrammatic perspective views of a sail structure to illustrate the action of siding tension ropes onto the sail.
Figure 17:
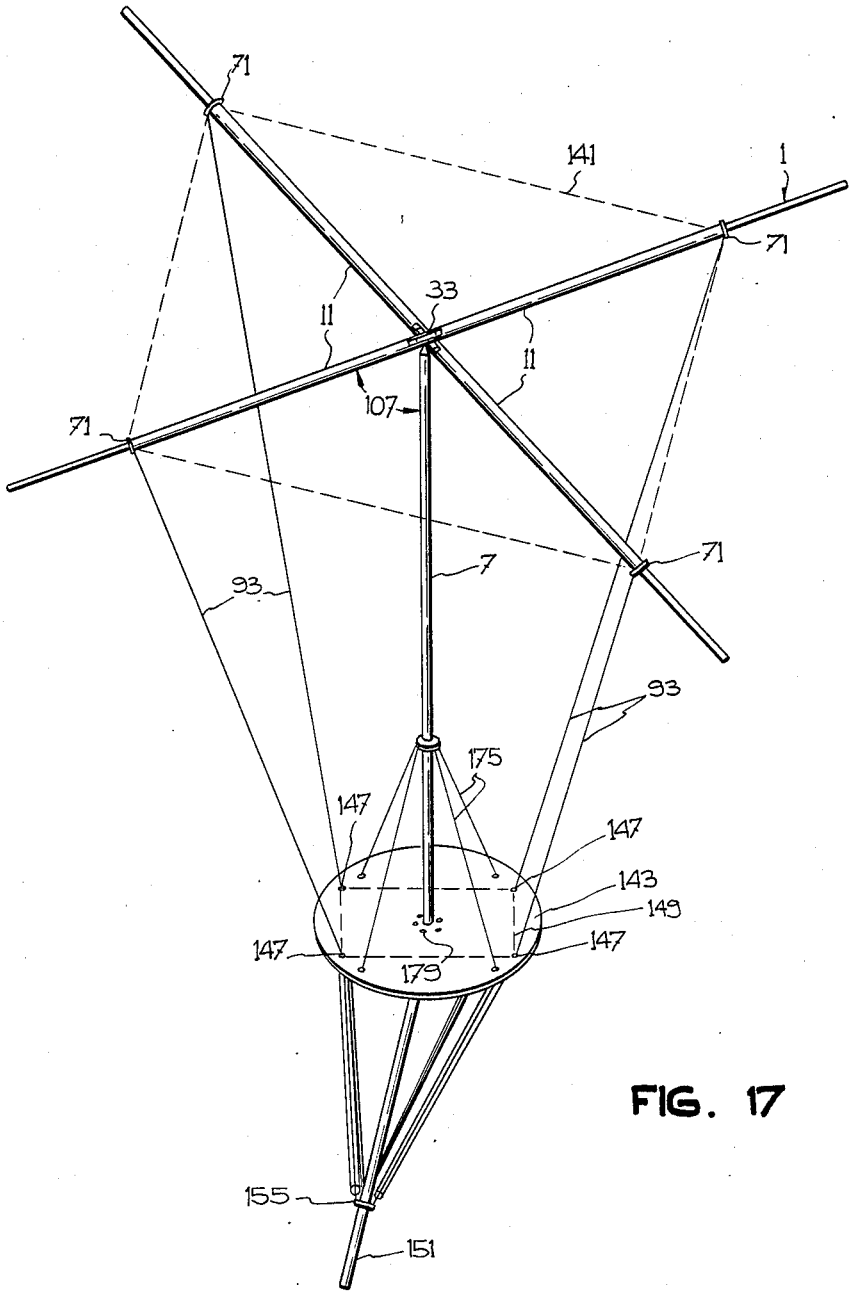
FIGS. 17 and 18 are partial and more detailed views of the sailing assembly of FIG. 16.

In a preferred embodiment, the rectangular sail 3 shown in FIGS. 14 and 15 is used in conjunction with the sail frame 1 shown in FIGS. 6 and 17. Their forward-backward symmetry of usage allows change of tacking course without the need to rotate the sail 3 around the axis of the mast 7. With the longer side held parallel to water, the center of gravity of the rectangular sail can be set low above water surface.

Simplicity of construction and lightweight are also significant factors. As shown in FIGS. 14 and 15, the sail tension is maintained by compression of the gaffs 11 of the sail frame 1, thus minimizing their strength requirement. The corners of the sail 3 are attached to eyelets 13 provided at the ends of the gaffs 11, in FIG. 6. Angle 15 in FIG. 6 between the sail frame gaffs 11 is naturally set by sail tension and tension of sail trim ropes.

As shown in FIG. 14, perimeter ropes 17 are each tied to two adjacent corners. Opposite sail perimeter ropes are more or less equally pulled to preserve symmetry since severe bending of the sail frame gaffs 11 would drastically reduce their resistance to compression. FIG. 14*b* shows sail shape without tension applied on all perimeter ropes. FIGS. 14*a*, 14*b* and 14*c* show respectively the same sail 3 with low, medium and high apparent concavity.

FIG. 15 shows the effect of added siding tension ropes 19. They are threaded through eyelets 21 fixed to the sail gaffs 11. Eyelets 21 are equally distant from the terminal eyelets 13 and this distance is about the same as the distance of the siding attachments from the corner of the sail. FIGS. 15*a* and 15*b* show the effect of pulling on one set; a wing-shaped sail is then obtained.

An increased pull onto the same set of siding tension ropes 19 increases this effect and the sail concavity. Left and right siding tension ropes 19 allow forward-backward symmetry of use. All sail trim ropes 19 are threaded through eyelets 23 in the top block 35 of the sail frame hinge, shown in FIG. 7, and then follow the mast 7 down to a sleeve 75 (disclosed in greater detail hereinafter).

FIG. 5 shows a sail assembly for small hulls, requiring no attachment to the hull. A mast base 25, in the form of a seat for the sailor, is just deposited at the bottom of the hull and the weight of the sailing gears extending beyond the hull side is counteracted by the sailor's weight on the seat. The sailor grasps the steering frame, to be further described below, which gives him immediate direct control of the sail tilt, the sail lateral angle and the sail rotation around the mast axis.

The wind force acting on the sail 3 is transmitted to the seating mast base 25. The sailor controls the position and the direction of the seating mast base 25 with his legs. The mast tilt can be changed rapidly through slipping of the seating mast base 25 across the curved bottom 27 of the hull 9. In a variant shown in FIG. 11, a worm mechanism 29 allows slow adjustment of the average mast tilt. Under normal tacking conditions, the sailor maintains the back of the seating mast base 25 close to the windward side of the hull 9 in order to lower the sail near the water surface and to counter the heeling torque generated the keel resistance and possibly also by the sail.

Figure 7:
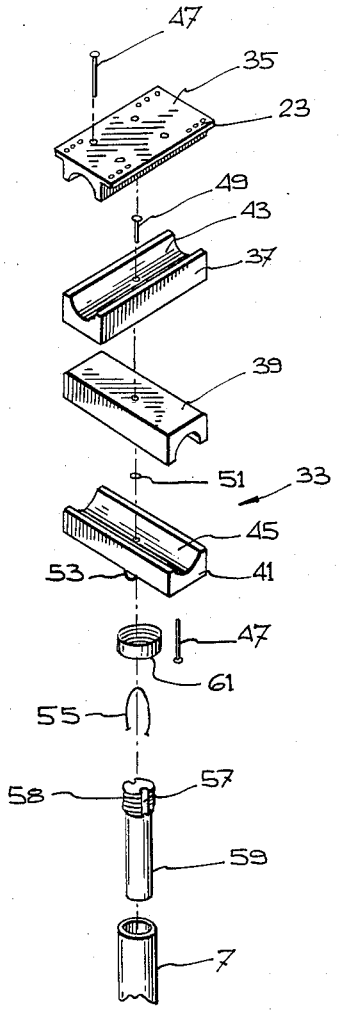
FIG. 7 is an exploded view of a universal joint used to connect the sail frame and the tip of the mast.

The sail steering mechanism 31 shown in FIG. 6 allows unlimited hinging of the sail frame 1 to the mast 7 without damage nor significant loss of control while sailing, through a hinge or universal joint 33 of the type shown in FIG. 7, for instance. Joint 33 is composed of a pair of blocks each made up of two cooperating shells 35, 37–39, 41, defining straight transversely arcuate beds 43, 45, each for the reception of one gaff 11; the shells being clamped and secured over the gaffs in any known manner as by screws 47 and the upper block 35, 37, being pivotely connected to the lower block 39, 41, by such means as a bolt 49 and nut 51 (through shells 37 and 39) to allow the blocks to rotate freely relative to one another about a vertical axis. The underface of the lowermost shell 41 has a transverse hook or eyelet 53 fixed thereto which interlaces with a U-shaped hook 55 of which the legs slide in grooves 57 across threads 58 formed at the top of a slide bar 59. The hook 55 is clamped in position by a ring 61 screwed over threads 58; the hooks 53, 55 and pivoted blocks 35 to 41 thus defining the universal joint 33. As to bar 59, it slidably freely lodges into an appropriate bore at the upper end of the mast 7 which then butts against the threads 58 or ring 61. This sub-assembly 33 thereby allows free rotation of the sail frame 1 about the mast 7 as well as hinging of the gaffs 11 by 0° to 180° with respect to the mast 7. Tension in the steering ropes near the ends of the frame gaffs 11 hold the slide bar 59 into the end bore of the mast 7.

Referring particularly to FIG. 6, the sail structure frame 1, formed by the crossed gaffs 11, has a rectangular sail 3 of which the corners are fixed to attachment points 13, in the form of eyelets. As shown, the points 13 are at the corners of a rectangle the diagonals of which are the gaffs 11 and the universal joint 33 points to the center of gravity of the sail 3.

The aforesaid steering mechanism 31 comprises a manually operable steering means 67, (FIG. 5) located adjacent the base 25 and rope means 69 which include sets of ropes operatively joining the steering means 67 and the sail structure at points of connection 71 located adjacent to the points of attachment 63 of the sail. The connection points 71 may, like the sail attachment points 63, be simple eyelets. With this arrangement and as will be seen further hereinafter, the steering means 67 and the rope means 69 can move the sail frame 1 and the sail 3 in unison about the universal joint 33 when the steering means 67 is manually operated. The points of rope connection 71 are at the corners of a rectangle 65, shown in dotted lines in FIG. 6.

Figure 10A:
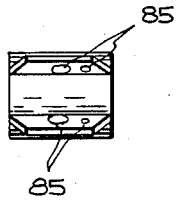
FIGS. 10*a* and 10*b* are side and front views of a rotating sleeve holding the twistable steering frame and pulleys along the mast in FIG. 6.
Figure 10B:
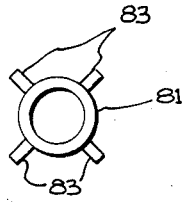

The steering means 67 comprise a manually operable closed steering frame 73 (FIG. 6) which is geometrically similar to the rectangle 65 of the connection points 71. Within the plane of the frame 73, when the latter is at rest, is a sleeve 75 rotatably mounted on the mast 7 and butting against a bushing 77 fixed to the mast 7. Finally, the steering frame 73 is held in circumscribing position around the mast 7 by flexible means in the form of four tension-adjustable cable stay devices 79 connected between the sleeve 75 and the corners of the steering frame 73. The sleeve 75 may take the form shown in FIG. 10 which consists of a short hollow tube 81 having radial flanges 83 pierced with holes 85 for receiving hooks at one end of the tension adjustable cable devices 79, and for threading the said trim ropes 17 and 19.

A similar arrangement of sleeve and bushing, 87 to 89, is shown above the first arrangement 75 to 77.

Rope means interconnect the steering frame 73, the sail frame 1 and the mast 7 so that motions applied to the steering frame 73 will be transmitted to the sail frame. Such means comprise, essentially, a pulley 91 at each corner of the steering frame 73; the second sleeve 87 of bushing arrangement 87 to 89 and rope lengths 93 each joining one point of connection 71 and the second sleeve 87 after winding around the relevant pulley 91. Each of the rope length 93 preferably has a portion which is part of a pulley-tackle 95 between the corresponding corner of the steering frame 73 and the second sleeve 87; the pulley-tackles 95 serving to amplify the steering movement onto the sail 3.

The rigidity of the sail frame 1 maintains the steering ropes 93 tight which in turn holds the rotary sleeves 75 and 87 tight against the collars 77 and 89 fixed to the mast 7.

Dotted rectangle 65 defined by the steering rope attachments 71 to the sail frame 1 is geometrically similar to the rectangle defined by the pulley attachments to the steering frame 73, as aforesaid. The ratio between these two rectangles and the position of the collar 89 are a set of geometric conditions related to the steering movement amplification on the sail frame 1 provided by sets of pulleys. The sail frame 1 and the sail steering frame 73 are practically parallel except when the sail frame 1 approaches the 0° to 180° limit with the mast.

Figure 9:
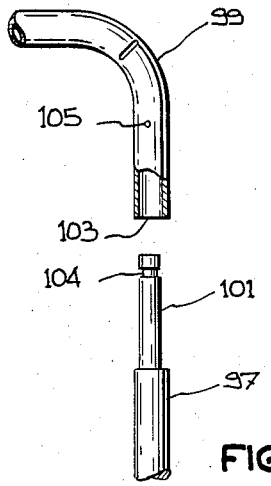
FIG. 9 is a partial side view of an elbow and bar at a corner of a twistable steering frame.

The sail steering frame 73 is maintained by the adjustable cable stay devices 79 and is twistable. Referring to FIGS. 6 and 9, the rectangular steering frame 73 has four straight bars 97 and four rigid right angular rounded elbows 99. As shown, each joint connecting one bar 97 to an adjoining elbow 99 is in the form of a terminal extension 101 of the bar 97 and of a bore 103 at one end of the elbow 99 into which the extension 101 is received for rotation. Disassembly is prevented by the provision of a suitable groove 104 and pin 105 arrangement. The steering frame 73 can thus be twisted out of a flat plane. As angle 107 between the gaffs 11 and the mast 7 gets increasingly acute under rotation of steering frame 73 about axis A—A, axis B—B is pulled towards the steering bushing 75 while axis A—A remains in the same position. This simple mechanical algorithm contributes to maintain all steering ropes 93 tight and to maintain the sail frame 1 practically plane under wide sweepage of sail frame angle 107 with the mast 7.

Because of geometric conditions, reduction of sail control is experienced as angle 107 between the gaffs 11 and the mast 7 approaches the 0° or 180° limit. This is of little consequence because these limits are not encountered while sailing. Unlimited hinging of the sail frame and of the sail steering frame is provided to avoid damage to assembly whenever the sail 3 gets into water. Then floatability of the sail frame is particularly appreciated. The sail can be restored into working position by its sweepage onto water surface followed by lifting while the sail is parallel to the wind direction.

Figure 8:
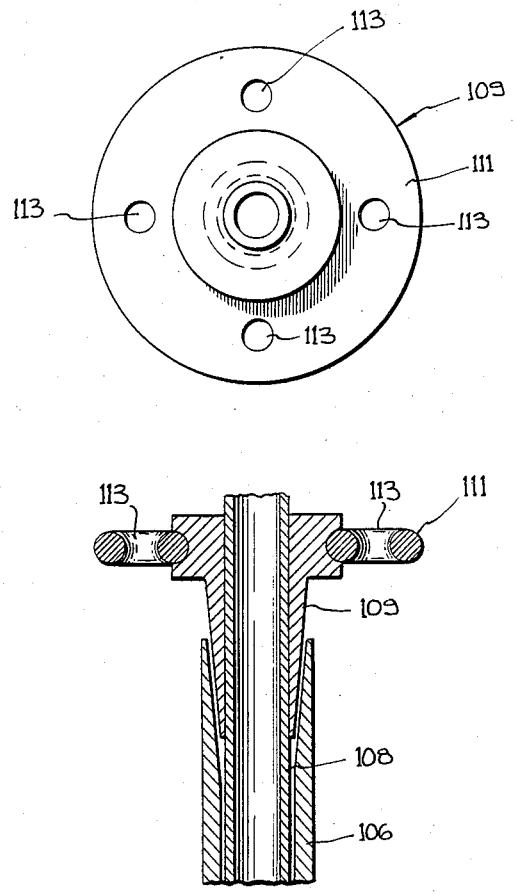
FIG. 8 shows a cross-sectional and a plan view of a typical waterproof joint for extensible sail frame gaffs.

The sail frame gaffs 11 can be made of collapsible tubings 106, 108 held together by waterproof tapered wedging bushing 109 in the manner shown in FIG. 8. The bushing 109 can advantageously have a free-rotating flange 111 formed with holes 113 serving for connecting the ends of the ropes 93. By means of such bushings 109, the sail frame gaffs can be extended to accomodate larger sails having the same length to width ratio without effect on the sail steering geometry.

Figure 11:
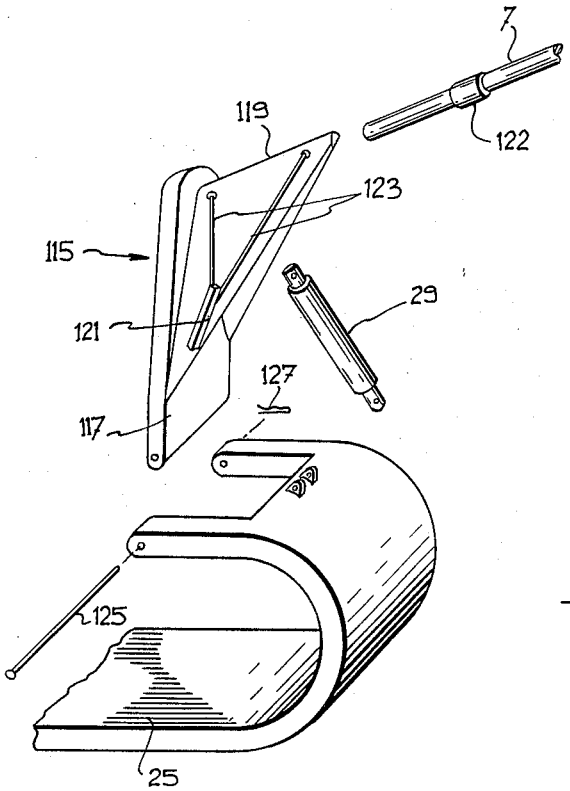
FIG. 11 is an exploded view of the hinge assembly for mounting the mast to the seat according to one embodiment.

One manner of mounting the mast 7 on the base 25 when the latter is free of the bottom of the hull 9 is shown in FIG. 11. It involves a hinge member 115 defining a hinge plate 117 and an open triangular housing 119 projecting from the plate 117. The lower end of the mast 7 is applied against the nick formed at the bottom of the triangular housing 119 and is held thereagainst by a cable tightening device 121; a collar 122 fixed to the mast 7 becomes located between the two cables 123 of the device 121 and thus prevent withdrawal of the mast 7. The end of the hinge plate 117, away from the housing 119, is mounted on the base for pivotal movement about a horizontal axis. This may be obtained by means of a pivot rod 125 slid transversely through the upper curved end of the base 25 and the lower end of the hinge plate 117, being held in position by a spring clip 127. Finally, the aforesaid manually operable axially extensible and retractible worm mechanism 29, having its ends appropriately pivoted, as shown, to the hinge member 115 and the rounded end of the base 25 allows pivotally adjusting the mast 7 to a predetermined tilt angle.

The inner front end of the seat 25 is rounded to prevent injuries to the belly and the thigh of the operator and for comfort whenever knee or thigh applies sideway force to the front end of the seat. Low profile back seat helps the sailor to apply backward leg force directly onto the seating mast base 25.

Figure 12:
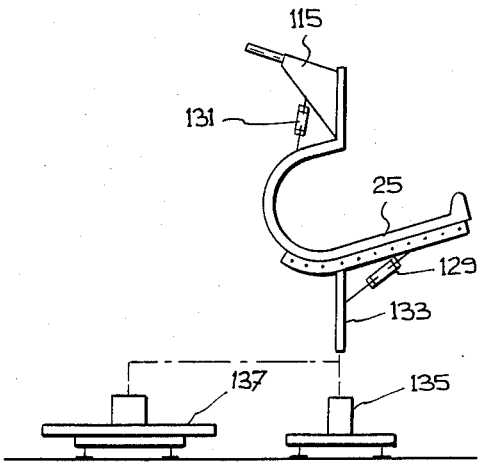
FIG. 12 is a side elevation view illustrating an adjustable seating mast base with leg mount.

FIG. 12 shows a seat mast base 25' provided with a chair tilt worm mechanism 129 and a mast tilt worm mechanism 131 of the same type and function as worm mechanism 29.

Furthermore, the seat base 25' has a leg 133 and is provided with numerous leg adjustment holes for the sailor to counteract the weight of the sail and the gears extending substantially beyond the hull side. This seating mast base is adaptable for best comfort of the sailor with various sizes and weights.

The seat leg 133 is freely inserted into a receiving tubular pedestal 135 anchored to the hull 9. The connection of the mast tilt to the hull tilt is then sturdier than with the seating mast base shown in FIG. 5. Control of the mast lateral angle for quick change of tacking course usually requires greater sailor's effort than the sail control; the receiving tubular pedestal 135 may then also include a boat steering mechanism 137 for amplification of the sailor's leg force. Receiving bases of seat leg 133 are preferably adjustable along longitudinal axis of the boat for easier control of mast lateral angle under various boat load conditions.

Figure 13A:
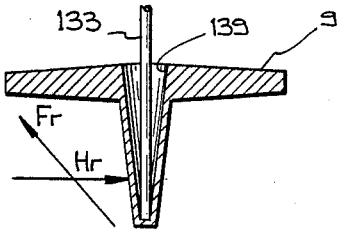
FIGS. 13*a* and 13*b* respectively show a cross-sectional view and a side elevation view of a sailboard with a keel and a long receiving hole for receiving a base leg as in FIG. 12.
Figure 13B:
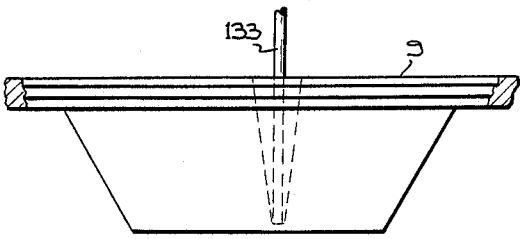

FIG. 13 shows a preferred manner of holding the seating mast base 25' of FIG. 12 to a sailboard. As shown, the seat leg 133 is received in a tapered hole 139, near the center of the keel, which goes down below the level of the sailboard lateral resistance Hr to water. The resultant sail force Fr, applied by the tip of the seat leg 133 below the level of sailboard lateral resistance Hr, generates a counter heeling torque that tilts the sailboard towards hydroplanning position. The force required to control the mast lateral angle M1 with sailboard direction is minimized with a short keel on a low profile sailboard. The lateral resistance to water is then concentrated near the seat leg even when sailing into waves.

Figure 18:
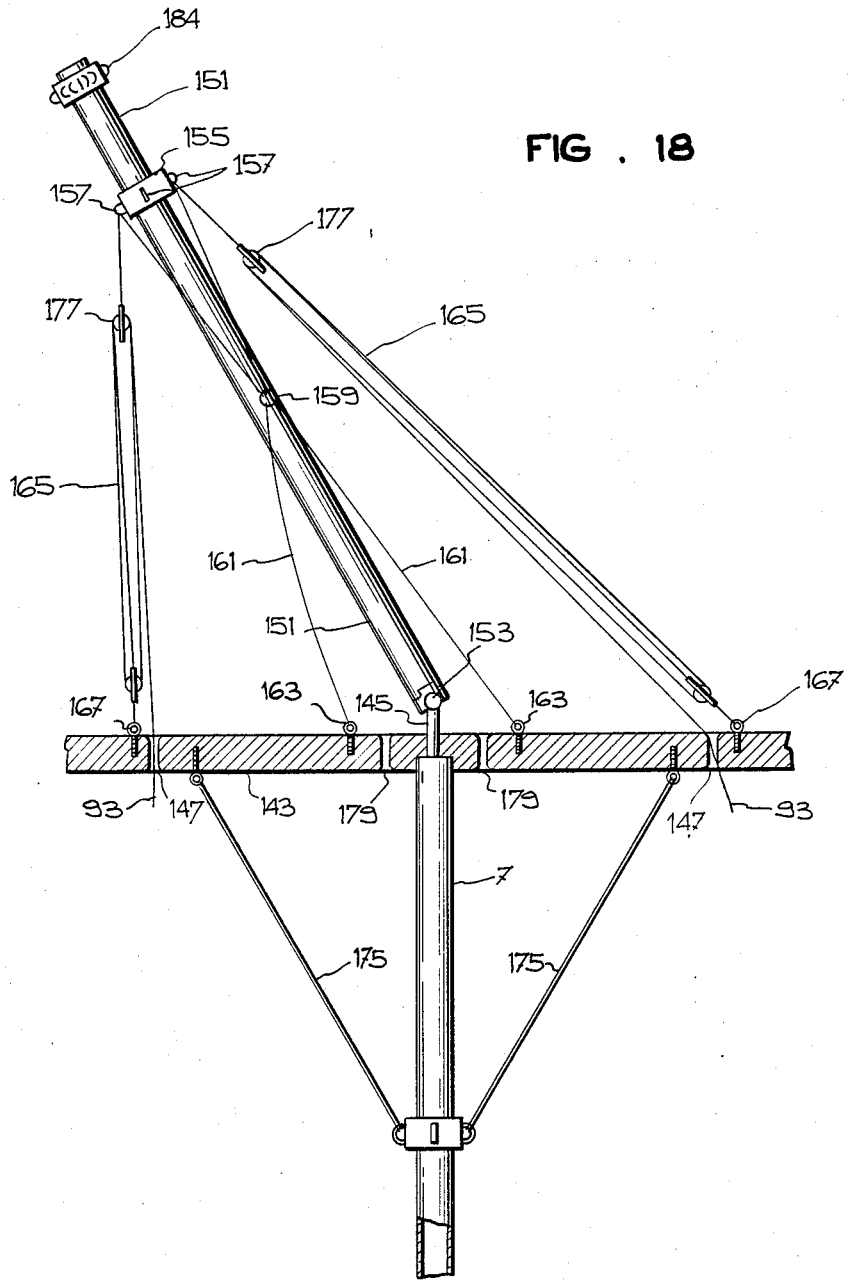

FIGS. 16, 17 and 18 show another preferred embodiment of the invention, suitable for heavier hulls, which also uses a rectangular sail 3 of which the corners are attached to the frame 1 at points 63 and the rope lengths 93 are connected at one of their ends at points 71 on the frame 1; these points 71 being thereby at the corners of a rectangle 141. In this case and as best seen in FIG. 18, this steering means comprises a mast plate 143 to which the mast 7 is solidly mounted at one end, by any known means, so that it projects perpendicularly from one of the faces of the mast plate 143. It will be noted that the mast 7 has an axial extension 145 (FIG. 18) that projects from the other face of the mast plate 143. Also notable, in FIGS. 17 and 18, are four guiding holes 147 that serve to guide the ropes 93 across the plate 143 and that are disposed at the four corners of a rectangle 149 which is geometrically similar to rectangle 141. Along with mast plate 143, the steering means comprises an elongated steering handle 151 connected to the mast extension 145 by a universal joint 153.

On the other hand, the rope means that operatively joins the steering means and the sail structure, includes a sleeve 155 fixedly mounted on the handle 151 at a distance from the universal joint 153; the sleeve 155 having rope guiding eyelets 157 therearound. Rope-length compensating means are also provided that include discs 159 (one only being shown) located between the sleeve 155 and the mast plate 143; these discs 159 being related to the mast plate by cords 161 of which one end is fixed to the discs 159 and the other to eyelets 163 of the mast plate 143 (FIG. 18). Finally, rope lengths 93, aforesaid, each join one point of connection 71 of the sail frame 1 and one of the discs 159 after having passed through a rope guiding hole 147 of the mast plate 143 and having wound around one rope guiding element of the sleeve 155.

As in the first embodiment, each rope lengths 93 is preferably part of a pulley-tackle 165 formed between one guiding element or eyelet 157, of the sleeve 155, and the mast plate 143 where one of its pulleys is fixed to an eyelet 167.

Referring to FIG. 16, the mast base comprises a stationary post 169 which is anchored to the hull along its longitudinal axis with its position preferably adjustable for easier control of mast lateral angle under various load conditions. A round steering plateau 171 tops the post 169 and is mounted to rotate thereon about a vertical axis so that the sailor may manually control the lateral angle M1 of the mast 7. A steering mechanism is preferably incorporated into the plateau 171 to amplify the sailor's force.

The mast 7 with its mast plate 143 is mounted on the base 169 and steering plateau 171 by means of hinge member 173 mounted on the plateau 171 so that it can both rotate with it about the vertical and also pivot or hinge about a horizontal axis across the plateau. The latter pivoting or hinging motion may be obtained by manually adjustable mechanism, such as pulley-tackles 175 disposed on either side of the hinge member 173 as shown in FIG. 16. It will be noted that the hinge member 173 has a flat portion and that the mast plate 143 is round and is mounted, in any convenient manner, on the flat portion for rotation about an axis normal to the said flat portion.

FIGS. 17 and 18 show complementary features of the sail assembly. Thus, cable stays 175 are used to maintain the mast 7 solidly normal to the mast plate 143. The sail frame 1 is steered by the ropes 93 guided through holes 147 of the mast plate 143 and then threaded through the sets of pulleys of the tackles 165.

The universal joint 153 allows hinging of the steering handle 151 from 0° to 180° in any direction.

The steering ropes 93 are kept tight by the rigidity of the sail frame 1 and by the steering assembly shown in FIG. 18. If the pulleys 177 of the tackles 165 were fixed to the sleeve 155, the steering ropes 93 would loosen whenever the angle 107 of a sail frame gaffs 11 with the mast 7 became very acute or very obtuse. As angle 107 of a sail frame gaff with the mast gets increasingly acute, the wire 161 approaches the sets of corresponding pulleys from the ring 155 then taking the slack in steering ropes otherwise generated. Although not shown, such a rope length compensator is also provided for set of pulleys corresponding to the other sail frame gaff.

As said above, the rectangle 141 defined by the steering rope connections 71 to the sail frame 1 is symmetrical to the rectangle 149 defined by the rope guiding holes 147 in the mast plate 143.

Pulley hooks 167 on the mast plate 143 are close to the corresponding guiding holes 147. The ratio between the rectangles 141 and 149 and the position of ring 155 on the steering handle 151 are a set of geometric conditions related to amplification provided by the steering pulley sets.

The sail rotation around the axis of the mast is provided by corresponding rotation of the mast plate 143 within its support 173. This mechanism is not shown. With low steering amplification provided by the sets of pulleys, rotational connection of the sail frame with the mast plate 143 is provided by tension of the steering ropes 93. However, a large sail could require unpractical dimension of the mast plate 143. The size of this mast plate can be reduced sizably if tortional connection between its plate and the sail steering is provided by the mast and if a high steering amplification is provided by the pulleys.

Sail trim ropes are threaded through holes 179 of the mast plate 143 and are tied to hooks provided on a ring 184 of the steering handle 151. As all controls for sail and mast are highly centralized, this assembly is particularly attractive for automated piloting.

What is claimed is:

1. A sail assembly for use with a hull, said assembly comprising:

a mast base;

a mast;

means for mounting said mast on said base for rotation of said mast about a vertical axis, said mast being so mounted as to extend at a mast tilt angle with respect to said vertical axis and having a tip at the end thereof away from said base;

a sail structure including a sail frame and a sail fixed to said frame at predetermined points of attachment thereon;

a universal joint mounting said sail frame on said mast tip for said mast tip to be at, or close to, the center of gravity of said sail;

manually operable steering means on said mast, adjacent said base; and rope means including ropes operatively joining said steering means and said sail frame at points of connection on said sail frame adjacent said points of attachment for moving said frame and sail in unison about said universal joint when said steering means are operated wherein said points of connection of said ropes on said sail frame are at corners of a geometrical figure;

wherein said steering means comprise:

a manually operable steering frame; and means for mounting said steering frame on said mast for free rotation and tilting about said mast axis;

said steering frame having junction points located at corners of another geometrical figure similar to said geometrical figure, each junction point being associated to one of said points of connection; and wherein said rope means comprises rope lengths each joining said points of connection on said sail frame and their associated points of connection on said steering frame.

2. A sail assembly for use with a hull, said assembly comprising:

a mast base;

a mast;

means for mounting said mast on said base for rotation of said mast about a vertical axis, said mast being so mounted as to extend at a mast tilt angle with respect to said vertical axis and having a tip at the end thereof away from said base;

a sail structure including a sail frame and a sail fixed to said frame at predetermined points of attachment thereon;

a universal joint mounting said sail frame on said mast tip for said mast tip to be at, or close to, the center of gravity of said sail;

manually operable steering means on said mast, adjacent said base; and rope means including ropes operatively joining said steering means and said sail frame at points of connection on said sail frame adjacent said points of attachment for moving said frame and sail in unison about said universal joint when said steering means are operated;

wherein said points of connection of said ropes on said sail frame are at corners of a geometrical figure;

wherein said steering means comprise: manually operable closed steering means having junction points located at corners of another geometrical figure similar to the said geometrical figure, each junction point being associated to one of said points of connection;

a first sleeve mounted on said mast for free rotation only about the mast axis, and located in the plane of said steering frame when said steering frame is at rest;

flexible means joining said first sleeve and said steering frame at said junction points; and wherein said rope means comprise:

a pulley on said steering frame at each of said junction points;

a second sleeve mounted on said mast for free rotation only, about the mast axis, and located intermediate said first sleeve and said universal joint, and rope lengths, each joining one of said points of connection and said second sleeve after winding around one of said steering frame pulleys.

3. A sail assembly as claimed in claim 2, wherein each of said rope lengths has a portion comprised in a pulley-tackle between one of said junction points and said second sleeve.

4. A sail assembly as claimed in claim 2, wherein said geometrical figures are similar rectangles.

5. A sail assembly as claimed in claim 2, wherein said base has the shape of a seat for seating a sailor and is adapted for freely lying, in use, at the bottom of the hull whereby said mast rotation may be controlled by movement of said seat.

6. A sail assembly as claimed in claim 5, wherein said mast mounting means comprise:

a hinge member defining a hinge plate and a housing projecting from one end of said plate;

means releasably securing the end of said mast away from said tip into said housing;

means mounting the other end of said hinge plate on said base for pivotal movement thereof about a horizontal axis; and a manually operable mechanism between said base and said hinge plate capable of pivoting and adjusting said mast at a predetermined tilt angle.

7. A sail assembly as claimed in claim 2 for use with a hull having a tapered bore, wherein said base has a rod-like leg removably fitting into said bore for rotation about said vertical axis.

8. A sail assembly as claimed in claim 4, wherein said steering frame comprises four straight bars, four right angular elbows, and means for joining said straight bars and said elbows to allow relative rotation therebetween about the longitudinal axis of said straight bars whereby to allow twisting of said steering frame out of a flat plane.

9. A sail assembly for use with a hull, said assembly comprising:

a mast base;

a mast;

means for mounting said mast on said base for rotation of said mast about a vertical axis, said mast being so mounted as to extend at a mast tilt angle with respect to said vertical axis and having a tip at the end thereof away from said base;

a sail structure including a sail frame and a sail fixed to said frame at predetermined points of attachment thereon;

a universal joint mounting said sail frame on said mast tip for said mast tip to be at, or close to, the center of gravity of said sail;

manually operable steering means on said mast, adjacent said base; and rope means including ropes operatively joining said steering means and said sail frame at points of connection on said sail frame adjacent said points of attachment for moving said frame and sail in unison about said universal joint when said steering means are operated;

wherein said points of connection of said ropes on said sail frame are at corners of a first geometrical figure;

wherein said steering means comprise:

a mast plate, having rope guiding holes therethrough disposed at corners of a second geometrical figure similar to said first geometrical figure;

means solidly mounting the end of the mast away from said universal joint, on one face of said mast plate for said mast to extend perpendicularly therefrom, said mast having an axial extension projecting from the other face of said mast plate:

an elongated steering handle;

a further universal joint interconnecting one end of said steering handle and said mast axial extension; and wherein said rope means comprise:

a sleeve mounted on said handle at a predetermined distance from said further universal joint, said sleeve having rope guiding elements therearound;

rope length compensating means including discs between said sleeve and mast plate and cords fixed at one end to said discs and fixed at the other end to said mast plate, adjacent said universal joint, and rope lengths, each joining one of said points of connection of said sail frame and one of said discs after having passed through one of said rope guiding holes of said mast plate and having wound around one of said rope guiding elements of said sleeve.

10. A sail assembly as claimed in claim 9, wherein each of said rope lengths has a portion comprised in a pulley-tackle between said mast plate and one of said guiding elements of said sleeve.

11. A sail assembly as claimed in claim 9, wherein said geometrical figures are similar rectangles.

12. A sail assembly as claimed in claim 9, wherein said mast base comprises a stationary post and a manually operable plateau mounted at the top of said post for rotation about a vertical axis, whereby rotation of said plateau controls the lateral angle of said mast through said mast mounting means.

13. A sail assembly as claimed in claim 12, wherein said mast mounting means comprise:

a hinge member having one end mounted on said rotary plateau for rotation therewith and for rotation about a horizontal axis across said plateau;

manually operable mechanisms, on either side of said hinge member and connected to said hinge member and to said plateau for pivoting said hinge member about said horizontal axis;

wherein said hinge member has a flat portion and said mast plate is mounted on said flat portion for rotation about an axis normal to said hinge member flat portion.

14. A sail assembly as claimed in claim 12, for use with a hull having a bottom, wherein the lower end of said post is anchored to said hull bottom.

15. A sail assembly for use with a hull, said assembly comprising:

a mast base;

a mast;

means for mounting said mast on said base for rotation of said mast about a vertical axis, said mast being so mounted as to extend at a mast tilt angle with respect to said vertical axis and having a tip at the end thereof away from said base;

a sail structure including a sail frame and a sail fixed to said frame at predetermined points of attachment thereon;

a universal joint mounting said sail frame on said mast tip for said mast tip to be at, or close to, the center of gravity of said sail;

manually operable steering means on said mast, adjacent said base; and rope means including ropes operatively joining said steering means and said sail frame at points of connection on said sail frame adjacent said points of attachment for moving said frame and sail in unison about said universal joint when said steering means are operated:

wherein said points of connection of said ropes on said sail frame are at corners of a geometrical figure;

wherein said steering means comprise:

a mast plate, having rope guiding holes therethrough disposed at corners of a second geometrical figure similar in shape to said first geometrical figure;

means solidly mounting the end of the mast, opposite said sail frame universal joint, on one face of said mast plate for said mast to extend perpendicularly therefrom, said mast having an axial extension projecting from the other face of said mast plate;

an elongated steering handle;

a further universal joint interconnecting one end of said steering handle and said mast axial extension; and wherein said rope means further includes:

fixation means mounted on said handle at a predetermined distance from said further universal joint; and rope lengths each joining one of said points of connection of said sail frame to said fixation means after having passed through one of said rope guiding holes of said mast plate.

* * * * *

UNITED STATES PATENT AND TRADEMARK OFFICE

CERTIFICATE OF CORRECTION

PATENT NO. : 4,788,924

DATED : December 6, 1988

INVENTOR(S) : Renald HAMEL

It is certified that error appears in the above-identified patent and that said Letters Patent is hereby corrected as shown below:

Col. 2, line 26, "figures" should read --figure--;

Col. 3, line 66, "S1" should read --Sl--;

Col. 5, line 43, "heel" should read --keel--;

Col. 8, line 4, "holds" should read --hold--;

line 16, "to" should read --or--;

Col. 9, lines 15, 19 and 38, "25'" should read --25--;

Col. 10, line 42, "175" should read --174--;

IN THE DRAWINGS:

Figure 2, reference "SL" should read --Sl--;

Figure 16, reference "175" should read --174--.

Signed and Sealed this

Twelfth Day of December, 1989

*Attest:*

JEFFREY M. SAMUELS

*Attesting Officer* *Acting Commissioner of Patents and Trademarks*